United States Patent [19]

Jackson

[11] 4,445,786

[45] May 1, 1984

[54] ELAPSED TIME ROD AND REEL APPARATUS

[76] Inventor: Ronnie L. Jackson, DET 193-1, PSC Box #1348, APO New York, N.Y. 09289

[21] Appl. No.: 430,824

[22] Filed: Sep. 30, 1982

[51] Int. Cl.[3] ..... G04B 47/00

[52] U.S. Cl. ..... 368/10; 43/17

[58] Field of Search ..... 43/1, 4.5, 15–17; 368/10, 113

[56] References Cited

U.S. PATENT DOCUMENTS 4,274,149 6/1981 Flanagan ..... 368/10

*Primary Examiner*—Vit W. Miska

*Attorney, Agent, or Firm*—John W. Huckert

[57] ABSTRACT

Apparatus for use by sportsmen, especially fishermen, for accurately recording elapsed time between the catching of a fish and the landing of same includes a fishing rod, a fishing reel with line mounted on said rod in conventional manner, a lure with hook at the free end of the fishing line, together with a timing device of digital type mounted on a handle portion of the fishing rod in a position which is easily viewable by a user of the equipment. A suitable actuating button, or buttons, is included with the timing device for the purpose of starting and stopping the stop-watch portion thereof. Additional actuating buttons may be provided for effecting illumination of the display of the timing device, and/or other timing functions of the device.

Another embodiment provides an analog type timing device as well as mounting upon the fishing reel itself rather than the fishing rod handle.

10 Claims, 6 Drawing Figures

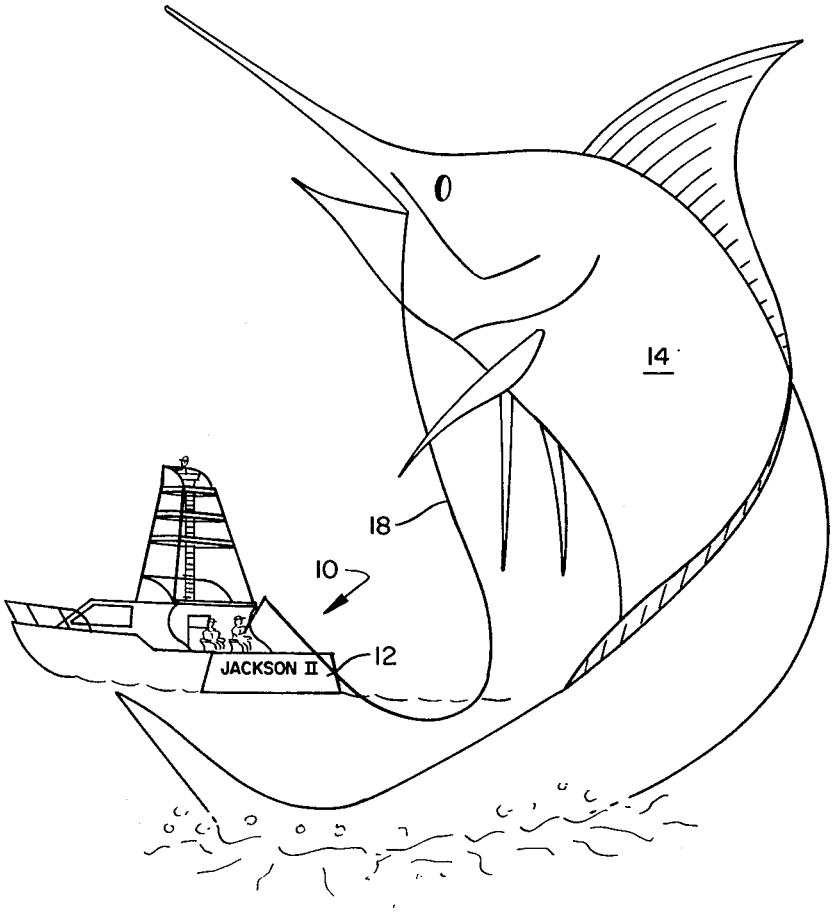
FIG. 1.
FIG. 5.
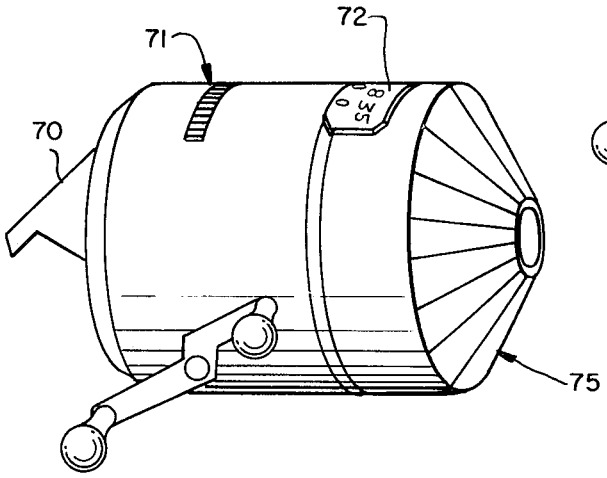
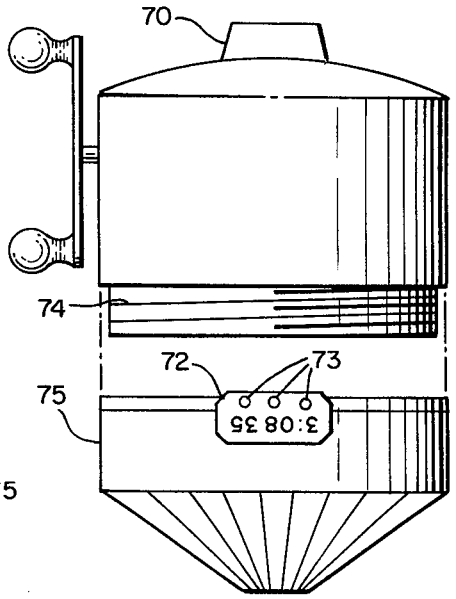
FIG. 6.

ELAPSED TIME ROD AND REEL APPARATUS

BACKGROUND OF THE INVENTION

1. Field of the Invention

This invention relates generally to devices for use by sportsmen, especially fishermen, for keeping an accurate time record of total time elapsed between hooking a fish and landing the fish.

2. Description of the Prior Art

A common problem with known elapsed time devices of conventional type is that they are not provided in combination with a fishing rod and reel apparatus. Another problem with known timing devices is that they are not designed so as to accurately record the "fighting time" it takes to land a fish after hooking same. Also, known timers generally do not record split or fractional seconds of elapsed time.

There have been devices devised to record the time of sporting events, but oftentimes these still are far from effective. Similarly, structures for timing events which are not physically or structurally attached to a rod and/or reel also leave much to be desired.

Existing prior patents which may be pertinent to this invention are as follows:

| | | |
|---|---|---|
| Flanagan | 4,274,149 | June 16, 1981 |
| Sollenberger | 4,287,964 | Sept. 8, 1981 |

These patents generally show timers for use with devices used by sportsmen. For example, the Flanagan patent discloses apparatus for providing superimposed readout of digital information onto the field of view of binoculars. That is, an LED display is mounted internally of binocular housing or a similar optical instrument, for the purpose of measuring elapsed time in a conventional manner. Switches for controlling the timing device are mounted so as to be activated by a user externally of the binoculars. Thus, when a user is watching a sports event such as a horse race, and once he has activated the timing device, he can see the display of elapsed time superimposed onto the image of the horses being observed through the binoculars.

The Sollenberger patent discloses a timer for use with toys such as ride-on vehicles, wherein a spring driven mechanical motor energizes the timing device, together with a manually displaceable mechanical switch for selective starting and stopping of the spring motor for measuring elapsed time of the toy ride.

However, none of the known prior art devices offers the new and novel features of the present invention.

SUMMARY OF THE INVENTION

An object of the present invention is to provide a timing device in combination with a fishing rod and reel for permitting a sportsman/user the option of accurately timing the amount of time required to land a fish after the hooking of the fish.

Another object of the present invention is to provide an easily installed timer device for fishing apparatus including a fishing rod and reel which can be mounted either permanently or semi-permanently therewith.

A further object of this invention is to provide a timing device of either the digital or analog type which can be easily and securely attached and combined with either a fishing rod or a fishing reel of a fishing rod and reel apparatus. Also, the timing device may be either battery (electric motor) or mechanically (spring motor) driven.

A still further important object of the present invention is to provide a timing device which is flexible in that it can be used at night because of provision of lighting the display portion of the timing device. The provision for stopwatch operation with timing as low as 1/100 of a second is also envisioned.

Another object of the present invention is to provide a timing device for use with fishing apparatus which is both fresh and salt water resistant, shock-proof, and also having stop-watch operating buttons easily accessible by a user of the device.

The present invention has a number of new and novel features. A number of these features are as follows:

(1) This miniature stop-watch type device can be attached to the rod as designed, however, it can also be mounted on the reel as well, whichever is most convenient to the individual fisherman's style.

(2) The watch type timer can be removably or permanently attached, so the battery(s), if so energized, can be replaced or recharged.

(3) The stop-watch type device can be as sophisticated as desired so as to contain all the modern features, as designed by watchmakers today.

(4) The watch timer will be installed in a place (location) so that when the user-fisherman sets the lure hook, the stop-watch can be activated simultaneously, the mounting location being wherever the fisherman feels most comfortable using the device.

(5) The watch device does not have to have digital or battery operated features, but it can be a manual (wind up type) with hands (analog).

(6) Additional features for the watch timer can be regular time of day, month, day, date, all features for every day use plus including lumination for night fishing.

(7) This watch type timer device can also include features such as being shock-proof, salt or fresh water resistant, or both, with stop-watch capabilities to record the elapsed time up to 1/100 of a second, if desired.

These together with objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the elapsed time rod and reel apparatus of the present invention as in use;

FIGS. 5 & 6 show another reel mounting modification.

DESCRIPTION OF THE PREFERRED EMBODIMENT

Figure 2:
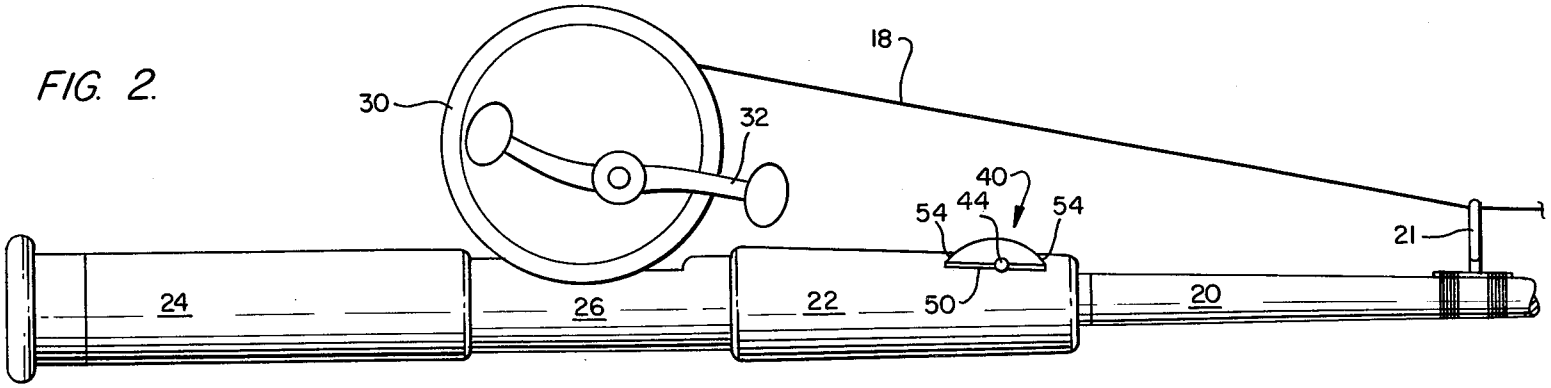
FIG. 2 is a side-elevational view of the apparatus combination of the present invention.

Referring to FIG. 1 of the drawing, reference numeral 10 indicates in general the elapsed time rod and reel apparatus of the present invention. This device is shown as being used by a sport fisherman aboard a boat for measuring and accurately recording the amount of elapsed time between the hooking (setting the lure) of a fish and the actual land of same aboard the boat.

Of course, a number of reasons exist why the sport fisherman would desire to know accurately the amount of time required to land a fish once hooked. It can be used as competition against one's self, that is, to try to improve the fishing skills of the user by competing against himself in previous catches by attempting to land a fish within a much lesser time frame. Also, it can be used for competition with other sportsmen having similarly equipped fishing apparatus to see who is the best, the poorest, etc. Also, it is a basis for betting between competitors, comparison between catching and landing fishing during the daytime as compared to nighttime fishing, etc.

Figure 3:
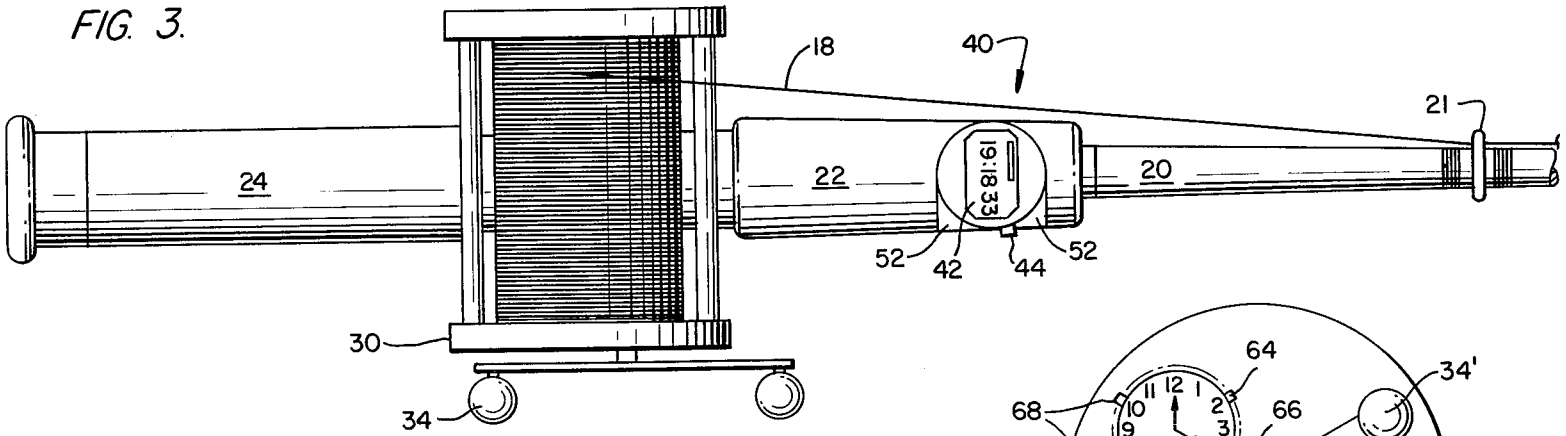
FIG. 3 is a top plan view of the timing device of FIG. 2.

FIG. 1 shows a fishing boat 12 having a number of sports fishermen aboard with one of them having hooked a large desirable specimen 14. The line 18 from the apparatus of the present invention is also shown as attached to a fishing lure with hook inside the fish (not shown), but of any desired conventional type. FIGS. 2 and 3 show the apparatus of the present invention in the preferred embodiment. A fishing rod 20 has a forehandle portion 22 and a rearhandle portion 24 with a reel supporting and holding attachment section 26. A fishing reel 30 is suitably mounted on the portion 26 of the rod. The reel preferably has a line traverse mechanism therewith for winding the line 18 smoothly and evenly upon the reel hub in conventional manner. An operating handle 32 actuates the drive mechanism of the fishing reel and has a freely rotatable gripping handle 34 extending from the outer end thereof. The rod 20 has a plurality of line guides 21 mounted thereon in wound on fashion for the line 18.

This fishing apparatus has been improved by adding a small or miniature digital stop-watch type timing device 40 to the forehandle portion 22 of the fishing rod. In FIG. 2, the recess 50 having tapered timer retaining edges 54 is shown. By use of this recess 50 the timing device can be either permanently or semi-permanently secured to the forehandle 22. The timing device is slid into the recess and retained by the tapered edges 54 therewithin. Small blocks 52 as shown in FIG. 3 can be attached to the outer edge areas of the recess to secure the timing device to the handle. These blocks 52 can be glued into place forming a permanent structure, or by use of screws or small clamps can be semi-permanent in nature. In the drawings the permanent installation is shown wherein the blocks 52 have been secured by glue so as to permanently hold the timing device mounted with the forehandle 22. However, easily, screws could be used for holding the blocks which would then form a semi-permanent installation.

In the preferred embodiment of FIGS. 2 and 3, a digital type timing device has been provided. Thus, ordinary time is shown in digital form, as well as the elapsed time when the device is used as intended by a sports fisherman. A single pushbutton 44 is indicated, and this single pushbutton operates the stop-watch portion of the timing device 40. That is, the first time the button 44 is pushed, the initial elapsed timing period will begin, and then the next time the pushbutton 44 is pushed, the timing period will be stopped, etc. Of course, additional buttons may be provided for actuating illuminating light within the display area of the timing device, controlling other functions of the timing device, and the like.

Figure 4:
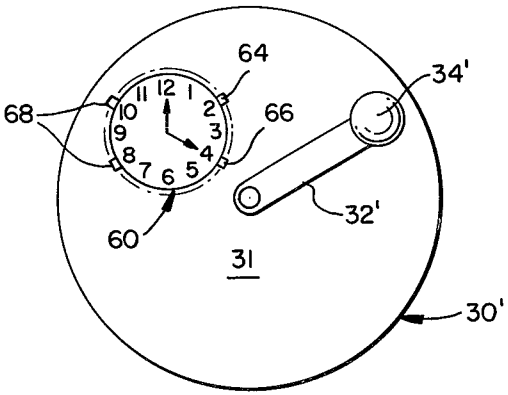
FIG. 4 is a side elevational view of a fishing reel per se having an analog timing device mounted thereon.

In FIG. 4, a modified embodiment of the present invention is shown. In this embodiment the timing device 40' has been mounted on the fishing reel itself 30'. The fishing reel 30' is also provided with a user reel drive handle 32' and pivotally mounted gripping portion 34'. In this embodiment, the timing device 40' is of the analog type and therefore has hands which are visible to the user of the device. Also shown are a plurality of pushbuttons 64, 66, and 68 which will control the stop-watch function of the timing device as well as illumination thereof for nighttime use, controlling various other desired functions of the timing device. Indicated by reference character 60 is a layer of glue between the backside of the timing device 40' and the side case 31 of the fishing reel. While the glue 60 forms a permanent installation of the timing device with the reel, semi-permanent type attachment structures may be utilized, such a tapered wedges, clamping screws, etc.

FIGS. 5 and 6 show a reel mounting modification of the elapsed time device of the present invention. As best seen in FIG. 5, a side view, the reel has a release/locking, push button 70 line control, a drag control button 71, and a digital type time device 72. The top plan view of FIG. 6 shows the control buttons 73 of the timing device 72 as attached to the reel cover 75. The reel cover 75 is screwed onto the main body of the reel by the threads 74.

Of course, in actual use, either embodiment will permit the sports fisherman an accurate and reliable apparatus and method of timing the actual amount of time required between hooking the fish and landing the fish. Of course it is desired that the degree of timing be to very small fractions of a second, preferably 1/100 of a second as the smallest timing amount.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. In combination with fishing equipment including a fishing rod, a fishing reel with line, and a lure with hook at the free end of said line, the improvement comprising:

timing means for said fishing equipment;

means for mounting said timing means on said fishing equipment in a position which is easily viewable by the user of the equipment; and additional means for effecting starting and stopping of said timing means to indicate the elapsed time necessary to land a fish after hooking the fish by the lure with hook.

2. A combination as set forth in claim 1, wherein said timing means comprises a digital type timing device.

3. A combination as set forth in claim 1, wherein said timing means comprises an analog type timing device.

4. A combination as set forth in claim 2 or 3, wherein said additional means comprise stop-watch capabilities included with the timing device together with appropriate start/stop actuating button.

5. A combination as set forth in claim 1, wherein said means for mounting said timing means on said fishing equipment includes a permanent type mounting arrangement.

6. A combination as set forth in claim 1, wherein said means for mounting said timing means on said fishing equipment includes a semi-permanent type mounting arrangement.

7. A combination as set forth in claim 6, wherein said semi-permanent type mounting means includes screws, double sided tape, and the like.

8. A combination as set forth in claim 5, wherein said permanent type mounting means includes a recessed portion in the handle of said fishing rod together with means for retaining said timing device within said recessed portion.

9. A combination as set forth in claim 8, wherein said mounting means further includes the use of glue to secure the timing device within said recess.

10. A combination as set forth in claim 5, wherein said mounting device is retained within said recess by using clamping blocks attached by screws to the fishing rod handle.

* * * * *